US009972287B2

(12) United States Patent
Gray et al.

(10) Patent No.: US 9,972,287 B2
(45) Date of Patent: May 15, 2018

(54) CLAMP FOR REMOVAL OF GUITAR BRIDGE PINS

(71) Applicants: William Gray, Los Angeles, CA (US); Allen Chance, Los Angeles, CA (US)

(72) Inventors: William Gray, Los Angeles, CA (US); Allen Chance, Los Angeles, CA (US)

( * ) Notice: Subject to any disclaimer, the term of this patent is extended or adjusted under 35 U.S.C. 154(b) by 0 days. days.

(21) Appl. No.: 14/464,687

(22) Filed: Aug. 20, 2014

(65) Prior Publication Data

US 2017/0116968 A1 Apr. 27, 2017
US 2018/0102112 A9 Apr. 12, 2018

Related U.S. Application Data

(60) Provisional application No. 61/867,954, filed on Aug. 20, 2013.

(51) Int. Cl.
*G10D 3/00* (2006.01)
*G10D 3/14* (2006.01)

(52) U.S. Cl.
CPC ..... *G10D 3/00* (2013.01); *G10D 3/14* (2013.01)

(58) Field of Classification Search
CPC ..... G10D 3/00; G10D 3/14
See application file for complete search history.

(56) References Cited

U.S. PATENT DOCUMENTS

2008/0302230 A1* 12/2008 Coco ..... B25B 27/00 84/458

* cited by examiner

*Primary Examiner* — Kimberly Lockett
(74) *Attorney, Agent, or Firm* — Quarls & Brady LLP

(57) ABSTRACT

Systems and devices are arranged as tools for guitar maintenance and particular for removing bridge pins of an acoustic guitar and adjusting stream of pictures of guitars. Eight 'clamshell' arrangement of complementary half element form a clan particularly devised to couple with hardware used to mount strength of a guitar i.e. bridge pins. The coupling is such that it is easy to establish and easy to remove whereby superior control of the bridge pin removal is achieved. As bridge pins are removed from a bridge, the bridge pins remain captive with respect to the clamp device thus preventing them from being dropped and/or lost—a problem common in competing alternative systems known in the arts.

19 Claims, 3 Drawing Sheets

CLAMP FOR REMOVAL OF GUITAR BRIDGE PINS

This application claims benefit from United States provisional application filed Aug. 20, 2013 having Ser. No. 61/867,954.

BACKGROUND OF THE INVENTION

Field

The following invention disclosure is generally concerned with devices for guitar maintenance and specifically concerned with a clamp apparatus for removal of guitar bridge pins.

Musicians have long been particularly particular with respect to care, tuning and maintenance of their instruments. Quality output from a musical instrument often depend upon the ability of artists to care for and tune the device. Accordingly, special efforts and approaches have been brought forth to aid musicians in realizing this care for their musical instruments.

One important example relates to the tuning and maintenance of acoustic guitars. Acoustic guitars typically have six strings fixed at a bridge by a mounting system known as bridge pins. He bridge pins fasten one end of a guitar string to a portion of a resonator called a bridge plate. When guitar strings have reached the end of their useful life due to normal wear, they may be replaced by new strings which are fitted into the same mountings at the guitar bridge and held in place by the original bridge pins.

To replace guitar strings, it is necessary to remove the bridge pins first. Guitar bridge pins may be pulled from their seeded place merely by applying a significant force along the bridge pins as in a direction away from the guitar body. Bridge pins are pressure or friction fit and are not held by any mechanical interlocking means that jazzy threaded fastener. Rather, these are pushed into place and held fast by pressure and friction alone. As such, removal of the pins can introduce difficulties and entrances with respect to the string change process. In particular, when a bridge pin is very well seated, it can be extremely difficult to dislodge from its seat as the force required to do so is considerable. In addition, when the seat does break, but they intends to release suddenly and in a manner which sometimes results in it being lost from the means by which it is pulled. And sometimes fall to the floor and can easily become lost. This is particularly true as the environments in which guitars are frequently used may include dark and cluttered stages.

Sometimes tools such as pliers are used to assure a significant pulling force may be applied. However, pliers are hard to hold when the pin releases suddenly. Further, pliers may damage bridge pins as they tend to put a very large transverse force to achieve grip on items to which they are applied.

Special-purpose bridge and polar tools have been devised. For example in U.S. Pat. No. 7,906,715, Coco et al, teach a nice system specifically for removal of bridge pins of an acoustic guitar. A housing and swinging arm structure provides a vivid function which permits the tool to input a certain advantageous leverage on the pin. One particular issue related to use of these systems relates to the cavity into which a bridge pin head may be received. The cavity does not hold him captive unless a removing force is continuously being applied. The moment the pin is freed from the bridge, but then tends to fall away from the tool and may become easily lost to the floor and surrounding environments.

Another version of a guitar bridge pin alert is presented in the teachings of U.S. Pat. No. D386,373. This very simple device having no moving parts is quite useful for removing bridge pins. However, the system similarly suffers the problem described above whereby once a bridge pin is dislodged from its seat at the bridge, it is free to fly away from the device and is easily lost.

Accordingly while the art is provided with good and useful devices, none are particularly suited for easy removal of guitar bridge pins while maintaining the pin It after release from its friction seat.

While systems and inventions of the art are designed to achieve particular goals and objectives, some of those being no less than remarkable, these inventions of the art have nevertheless include limitations which prevent uses in new ways now possible. Inventions of the art are not used and cannot be used to realize advantages and objectives of the teachings presented herefollowing.

SUMMARY OF THE INVENTION

Comes now, William Gray and Allen Chance with inventions of a clamp apparatus for removal of guitar bridge pins. It is a primary function of these devices to provide means of easily, securely and safely removing guitar bridge pins from an acoustic guitar. It is a contrast to prior art methods and devices that systems first presented here reliably remove bridge pins and do not cause damage to guitars on which they are used. A fundamental difference between bridge pins pullers of the instant invention and those of the art can be found when considering its unique shape and configuration which lends to its ease of use and utility.

OBJECTIVES OF THE INVENTION

It is a primary object of the invention to provide apparatus for guitar maintenance.

It is an object of the invention to provide systems from removing the bridge pins of an acoustic guitar.

It is a further object to provide devices which avoid damage to a guitar while permitting easy removal of bridge pins.

A better understanding can be had with reference to detailed description of preferred embodiments and with reference to appended drawings. Embodiments presented are particular ways to realize the invention and are not inclusive of all ways possible. Therefore, there may exist embodiments that do not deviate from the spirit and scope of this disclosure as set forth by appended claims, but do not appear here as specific examples. It will be appreciated that a great plurality of alternative versions are possible.

BRIEF DESCRIPTION OF THE DRAWING FIGURES

These and other features, aspects, and advantages of the present inventions will become better understood with regard to the following description, appended claims and drawings where:

DETAILED DESCRIPTION AND PREFERRED EMBODIMENTS

Figure 1:
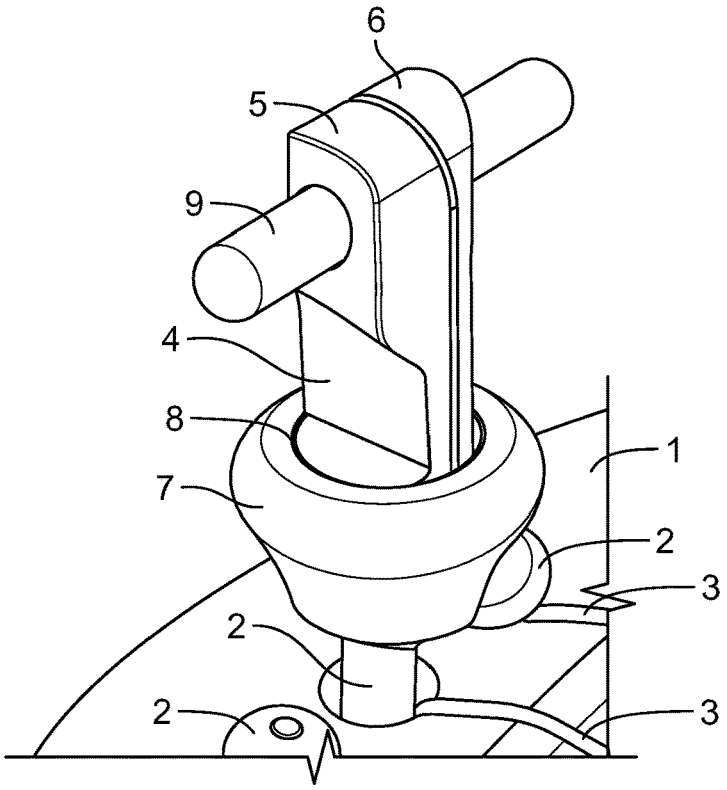
FIG. 1 is diagram of a device of these teachings in use and engaged with a guitar bridge pin held captive therein.

A clamp of these systems is particularly characterized as a device suitably arranged for gripping guitar bridge pins in a manner whereby they may be easily removed from their seat while additionally being held captive after the bridge pin is released thus preventing loss.

A clamp apparatus of these systems is formed of two 'half elements' which are complementary in shape to form a receiving cavity into which the head of a bridge pin may be inserted and held. Once the clamp is properly engaged with the head of a bridge pin, a guitarist may pull gently on a pull handle of the device provided for economic coupling with respect to two fingers of one hand. When pulled by the handle, the clamp applies a removing force to the bridge pin without any damaging transverse compression forces which tend to be harmful to the bridge pin which otherwise can be experienced when using common pliers to remove them.

Sudden release of the bridge pin from its seat at the guitar bridge does not result in a breach of the clamps coupling on the bridge pin. Rather, the bridge pin is held captive within the receiving cavity of the puller clamp even after the pin is separated from the guitar bridge. This assures the pin does not 'fly away' nor fall to the floor, but is instead held by the clamp for removal manually by the operator of the device.

Systems used heretofore required the operator to quickly secure the bridge pin with one's fingers immediately after it is dislodged from the bridge or else risk loss of the bridge pin. As bridge pins are nearly always members of a matched set, loss of a single bridge pin is very inconvenient.

Once a bridge pin is successfully removed from the guitar bridge, and remains captive in the clamp device to prevent loss, it may be removed therefrom prior to use of the tool on any succeeding bridge pin. To release a bridge pin held in a captive state from the clamp device, a sliding collar element is pushed in an axial direction away from the receiving cavity. So manipulated, the clamp device comprised of two complementary half elements is set into a 'released' or 'open' state whereby the receiving cavity is breached and no longer serves to captivate the bridge pin. The bridge pin is then safely removed from the clamp while it is not under any applied force and it is very easy to hold with one's fingers.

Thereafter, the clamp puller may be applied to another bridge pin. The head of a bridge pin remaining seated is placed into the receiving cavity of the puller or clamp. Then, the sliding collar element is moved downwardly along the puller axis until it slides over to shoulder portions of the half elements; one shoulder for each half. This action causes the receiving cavity to become integrated in a manner whereby the head of a bridge pin is held captive therein. As such the clamp may be used again to apply a strong pulling force which causes the bridge pin to become unseated from the bridge while being held captive in the receiving cavity at the bridge pin head.

The action of sliding the collar between two positions characterized as a 'close' position and an 'open' position permits bridge pins to be captivated or released respectively.

When one desires to engage a bridge pin for removal, the clamp is manipulated from an open to a closed state, and when a bridge pin is to be removed from the clamp, the collar is moved from a closed to open position by sliding on/off the shoulder portions of the complementary half elements.

One will gain a more complete understanding in view of the diagrams provided as FIGS. 1-5.

FIG. 1 illustrates a clamp puller device of these inventions engaged upon an acoustic guitar bridge pin and more specifically he bridge pin with a head portion held captive within a receiving cavity of the clamp's two half elements.

A guitar 1 includes string mounting fixtures known as a bridge pins 2 which are used to affix guitar strings 3 to a guitar at its bridge. A clamp or puller device 4 is comprised of two complementary half elements—a 'left' half 5 and a 'right' half 6 which may be mirror image complements. A collar element 7 may be moved between two positions as it is slightly movable along the axial direction or about a system symmetry axis. Each half element includes a shoulder portion 8 upon which the collar mechanically couples to cause the paths form an integrated receiving cavity.

In a second state, the clamp having the collar removed from the shoulders of the half elements permits a bridge pin to be released from captivity in the receiving cavity.

A pull handle 9 is provided in support of a primary function to permit a preferred ergonomic pulling grip. Sometimes the bridge pins of a guitar are very tightly seated in the bridge making removal difficult. A pulling force applied along the bridge pin axis operates to unseat a bridge pin from the guitar bridge. As such, when a human hand is used to apply this pulling force, it is preferable that the fingers of a single hand are used to grip a pull handle as shown which may be easily engaged thereby. As a secondary function, the handle operates to hold together the two half elements from which the device is formed. Specifically, the handle is fitted with respect to the half elements such that it passes through holes in each of the two half elements whereby the elements are permitted to move with respect to each other and separate slightly at a common mid-plane. In so doing, the half elements cause a receiving cavity to be in an open state whereby the head of a bridge pin may be inserted into or removed from cavity therein.

Figure 2:
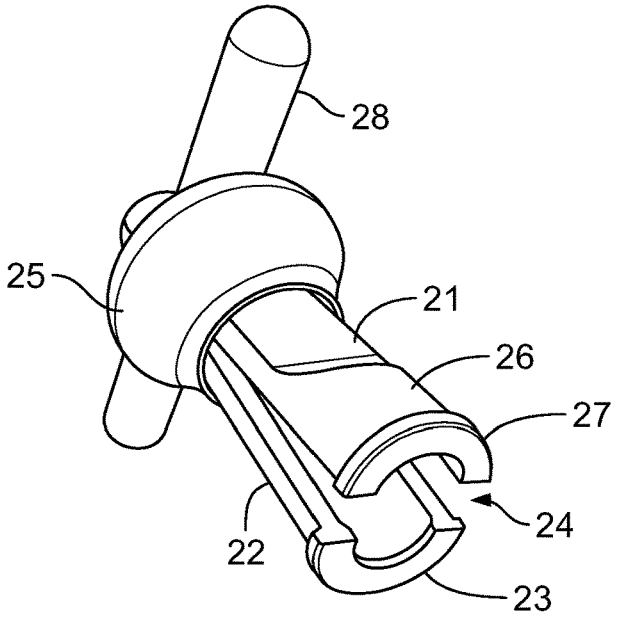
FIG. 2 is a perspective view of a clamp apparatus of these inventions in a 'open' state.

The open state is more readily appreciated in view of FIG. 2 which shows a device in this condition. A clamp in an open state includes two half elements complementary in shape having a right half 21 and mirrored left half 22 which operate together to form receiving cavity 23.

When in the 'open' state as illustrated in the diagram, separation at the mid-plane 24 causes the receiving cavity to open whereby the head of a bridge pin may be inserted therein. Once inserted, the collar element 25 may be slid downwardly along the axes to the shoulder 26, the collar stopping at keeper lip 27 which mechanically prevents the collar from sliding past the edges of the half elements.

The collar is further retained concentric with the axes and stopped from sliding past the handle 28. The collar thus has two operational positions which give rise to the clamps open state and closed states.

The open state is illustrated in FIG. 2 where the collar is at the top of its range of movement. A closed state (not shown) is characterized when the collar is at the bottom of the range of movement and is abutted up against the keeper lip about the shoulders.

Figure 3:
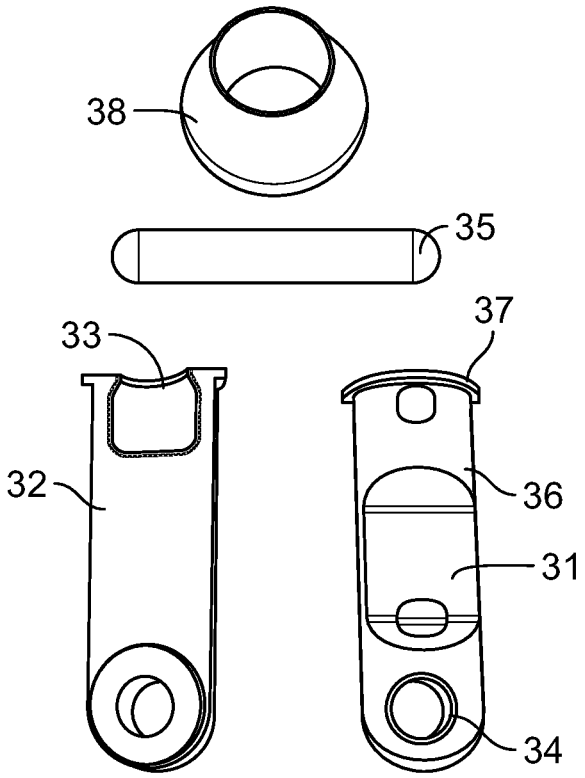
FIG. 3 is an illustration of an apparatus in a disassembled state.
Figure 4:
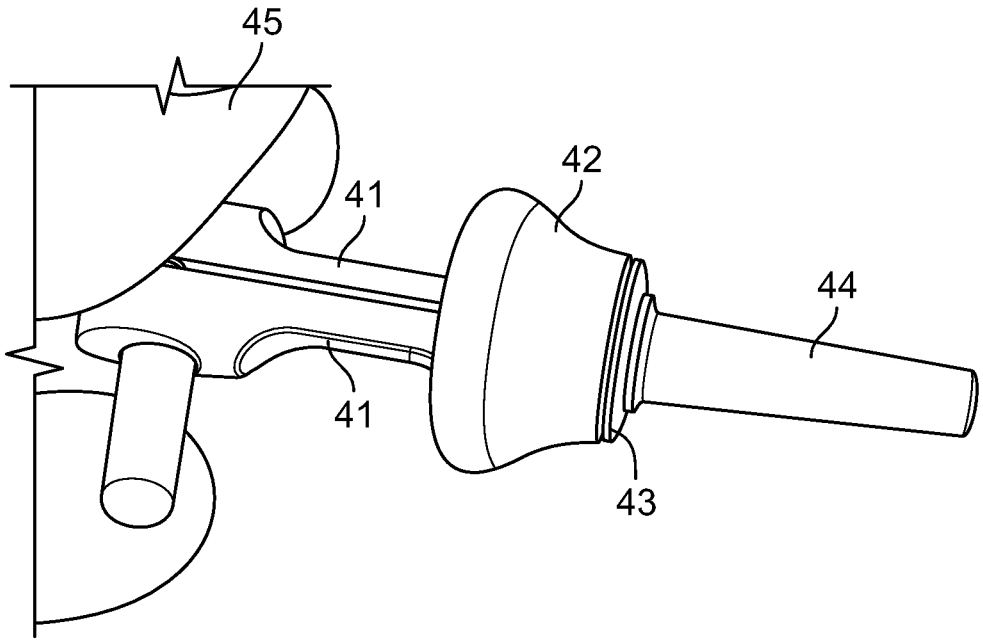
FIG. 4 illustrates a device in use where a bridge pin has been removed from a guitar bridge yet still remains captive in the clamp device.
Figure 5:
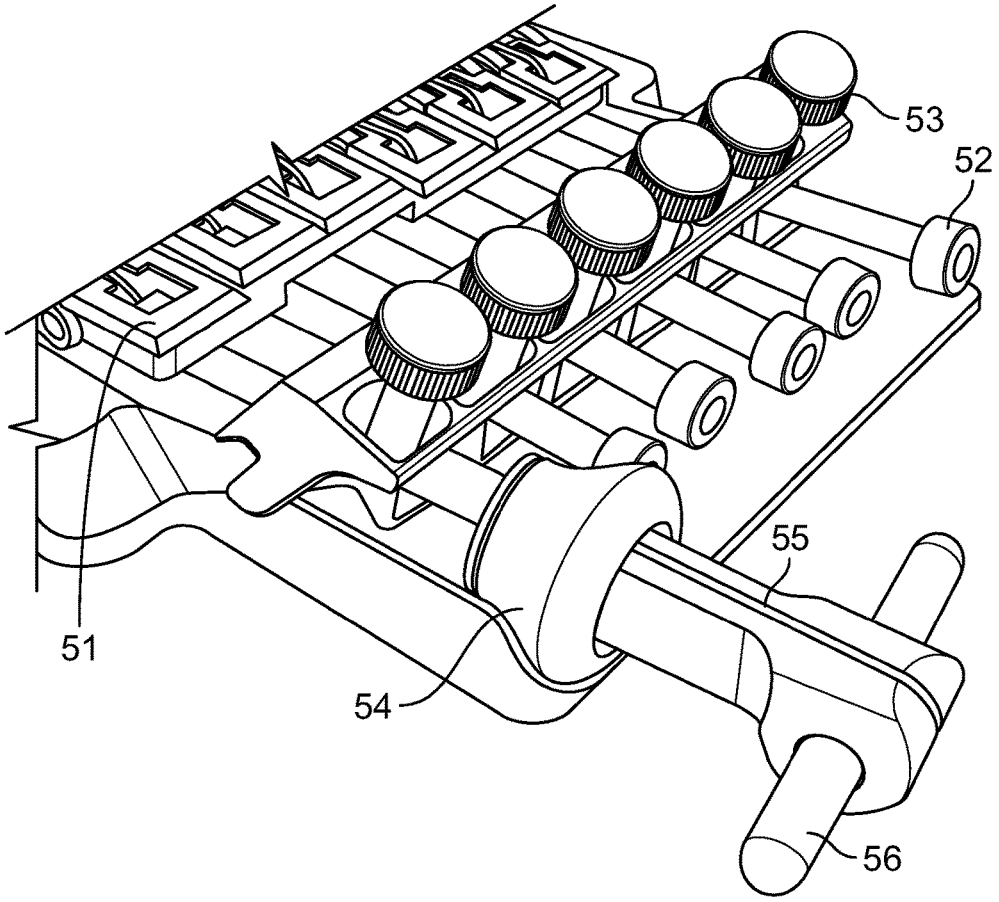
FIG. 5 illustrates a special purpose application where the clamp may be used to tune the strings of a Floyd Rose version of a bridge for electric guitars.

It is useful to consider the device where its constituent elements are physically separated in a manner where their precise shape can be better appreciated. FIG. 3 shows 4 elements in separation.

A 'right' half element 31 is a mirror image of a 'left' half element 32 when well-aligned and coupled together form a receiving cavity 33 into which a bridge pin head may be received. These parts are preferably molded from a hard plastic material. A through hole 34 is formed into each element at one end through which a pull handle 35 may be inserted. The handle is preferably an elongated cylindrical element suitable for being engaged by human fingers. This pull handle is preferably between about between two and ten centimeters in length and between about 5 and 25 millimeters in diameter. A shoulder portion 36 of the half elements provide a snug seat upon which a collar 37 may be fitted. A keeper lip 37 prevents the collar from passing the end of the two half elements when assembled together.

An assembled device held by a user illustrating a captive bridge pin having been just removed from a guitar bridge. The two complementary half elements 41 are contained by collar element 42. Which has been pushed down upon a shoulder which forces the half elements together at a mid-plane and further causes a receiving cavity 43 into a closed state which holds therein a bridge pin 44. Easily held by a user's fingers 45, the device is ideal for manipulating the bridge pins of an acoustic guitar and more precisely for removing those bridge pins.

In an important related application, this tool may additionally be used in a tuning process for some kinds of electric guitars. In particular, electric guitar which have a Floyd Rose style bridge.

In these systems an intonation block 51 seats a guitar string via a set bolt 52 which holds the strings therein the intonation block. The bolt may be pulled to put the string under tension. To adjust the vibrational frequencies of the strings, the tension must be tuned as desired. Once a satisfactory tension is achieved a lock screw 53 may be set to hold the set bolt in place assuring the correct tension and position of the intonation block.

A difficulty arises when one desires to adjust the system while under tension. It is very difficult to pull on the set bolt with sufficient tension to correctly adjust a string. This is primarily due to the poor grip that one may achieve when grasping the hand of the set bolt with fingers or even pliers. Accordingly, the device taught herein also operates quite well to adjust these types of bridges used on electric guitars.

In accordance with each of preferred embodiments of the invention, clamp apparatus are provided. It will be appreciated that each of the embodiments described include an apparatus and that the apparatus of one preferred embodiment may be different than the apparatus of another embodiment. Accordingly, limitations read in one example should not be carried forward and implicitly assumed to be part of an alternative example.

One will now fully appreciate how clamp apparatus for guitar bridge systems may be realized. Although the present invention has been described in considerable detail with clear and concise language and with reference to certain preferred versions thereof including best modes anticipated by the inventors, other versions are possible. Therefore, the spirit and scope of the invention should not be limited by the description of the preferred versions contained therein, but rather by the claims appended hereto.

We claim:

1. A clamp apparatus for removing bridge pins of an acoustic guitar comprising:

two complementary mirrored half elements; and a sliding collar, that is disposed about the half elements whereby the half elements are held firmly together by the collar when the collar is positioned at a distal end of the clamp apparatus.

2. The clamp apparatus of claim 1, the half elements each comprising:

a shoulder that is formed as a mechanical complement with respect to an interior annulus of the collar; and a recessed end that, when the half elements are held together, forms part of a receiving cavity configured to receive and hold a guitar bridge pin head.

3. The clamp apparatus of claim 1, further comprising an ergonomic pull handle that is fitted into the half elements, to hold the half elements in an alignment which permits the collar to slide axially about the half elements.

4. The clamp apparatus of claim 3, wherein the pull handle is sized and arranged to permit engagement of human fingers to permit an optimal pulling grip.

5. The clamp apparatus of claim 4, wherein the pull handle is about between two and ten centimeters in length and between about 5 and 25 millimeters in diameter.

6. The clamp apparatus of claim 2, wherein the receiving cavity formed by the two complementary half elements exists in an open state, when the collar is disengaged with respect to the shoulders of the half elements, and a closed state, when the collar is engaged about the shoulders of the half elements.

7. A clamp apparatus comprising:

a first clamp element;

a second clamp element that is complementary to the first clamp element, wherein the first and second clamp elements together form a receiving cavity configured to receive and hold a guitar bridge pin head;

a collar that is disposed about the first and second clamp elements, wherein first and second clamp elements are held firmly together when the collar is slid to a first position along an axis of the clamp apparatus, and wherein the first and second clamp elements separate at a common mid-plane of the clamp apparatus when the collar is slid to a second position along the axis.

8. The clamp apparatus of claim 7, wherein the first and second clamp elements each comprise:

a shoulder that is complementary to an interior ring of the collar, wherein the collar overlaps the shoulder when slid to the first position.

9. The clamp apparatus of claim 8, wherein, when the collar is slid to the second position, the receiving cavity formed by the first and second clamp elements is in an open state in which the receiving cavity can receive the guitar bridge pin.

10. The clamp apparatus of claim 9, wherein, when the collar is slid to the first position, the receiving cavity formed by the first and second clamp elements is in a closed state in which the receiving cavity is configured to securely hold the guitar bridge pin.

11. The clamp apparatus of claim 10, wherein the first and second clamp elements each further comprise:

a keeper lip that mechanically prevents the collar from passing the end of the clamp apparatus.

12. The clamp apparatus of claim 11, further comprising:

an ergonomic pull handle that is fitted into holes of the half elements at another end of the clamp apparatus.

13. A clamp apparatus comprising:

a first plastic element;

a second plastic element that is a mirrored counterpart of the first plastic element;

a pull handle that is fitted into holes of the first and second plastic elements; and a collar disposed around the first and second plastic elements, wherein the pull handle and the collar couple the first and second plastic elements together to form a receiving cavity for a guitar bridge pin.

14. The clamp apparatus of claim 13, wherein, when the collar is slid to a first position along an axis of the clamp apparatus, the clamp apparatus is placed in an open state in which the first and second plastic elements are configured to separate slightly at a common mid-plane and in which the receiving cavity is configured to receive the head of the guitar bridge pin.

15. The clamp apparatus of claim 14, wherein, when the collar is slid to a second position along an axis of the clamp apparatus, the clamp apparatus is placed in a closed state in which the first and second plastic elements are held firmly together and are thereby configured to hold the guitar bridge pin captive.

16. The clamp apparatus of claim 15, wherein the first and second plastic elements each comprise:

a lip that mechanically prevents the collar from passing the end of the clamp apparatus.

17. The clamp apparatus of claim 16, wherein the collar is directly adjacent to the pull handle in the first position and is directly adjacent to the lip in the second position.

18. The clamp apparatus of claim 17, wherein the first and second plastic elements each comprise:

a shoulder that is complementary to an interior ring of the collar.

19. The clamp apparatus of claim 18, wherein the collar overlaps the shoulder when the collar is in the first position.

* * * * *